US011407553B2

(12) United States Patent
Wu et al.

(10) Patent No.: US 11,407,553 B2
(45) Date of Patent: Aug. 9, 2022

(54) PACKAGING STRUCTURE WITH RESILIENT POSITIONING FLAPS

(71) Applicant: Alpha Networks Inc., Hsinchu (TW)

(72) Inventors: Pin-Ying Wu, Hsinchu (TW); Hsin-Yi Chang, Hsinchu (TW); Tung-Yen Yang, Hsinchu (TW)

(73) Assignee: Alpha Networks Inc., Hsinchu (TW)

( * ) Notice: Subject to any disclaimer, the term of this patent is extended or adjusted under 35 U.S.C. 154(b) by 0 days.

(21) Appl. No.: 17/227,319

(22) Filed: Apr. 11, 2021

(65) Prior Publication Data

US 2022/0161961 A1 May 26, 2022

(30) Foreign Application Priority Data

Nov. 20, 2020 (TW) ..... 109140880

(51) Int. Cl.
*B65D 5/50* (2006.01)

(52) U.S. Cl.
CPC ..... *B65D 5/5038* (2013.01)

(58) Field of Classification Search
CPC ..... A47G 1/06; A47G 1/0633; B31D 5/00; B65D 5/505038; B65D 5/504; B65D 5/5042; B65D 5/5052; B65D 5/5069; B65D 5/52; B65D 5/5253; B65D 85/68
USPC ..... 206/486, 588, 592
See application file for complete search history.

(56) References Cited

U.S. PATENT DOCUMENTS 4,019,672 A * 4/1977 Giannini ..... B65D 5/5069 206/592
4,244,128 A * 1/1981 Russell ..... A47G 1/0633 40/789
5,341,931 A * 8/1994 Prochaska ..... B65D 5/504 206/592
5,385,238 A * 1/1995 Lancaster ..... B65D 5/5042 206/591
5,884,767 A * 3/1999 Peng ..... B65D 5/5253 206/320
9,731,861 B2 * 8/2017 Cram ..... B60P 7/135

FOREIGN PATENT DOCUMENTS

DE 102011011673 B4 * 7/2016 ..... A47G 1/0633

* cited by examiner

*Primary Examiner* — Bryon P Gehman
(74) *Attorney, Agent, or Firm* — CIPO IP Group

(57) ABSTRACT

A packaging structure having resilient positioning flaps can have a particular shape formed by folding a planar sheet including a left fixing portion, a right fixing portion, and a main body portion whose left and right edges are each respectively connected to a connecting portion. The connecting portions are connected to the left and right fixing portions, respectively. Two spaced-apart pressed lines are formed on each fixing portion so that the fixing portions can be bent toward the main body portion along the press lines. Each fixing portion is formed with an opening having a portion of its periphery formed with cuttings extending away from the opening to form resilient positioning flaps. When the package structure is folded and a product is extended therein from the openings, the resilient positioning flaps can be engaged in a concave space of the product to position the product in the packaging structure.

12 Claims, 10 Drawing Sheets

PACKAGING STRUCTURE WITH RESILIENT POSITIONING FLAPS

CROSS-REFERENCE TO RELATED PATENT APPLICATION

This non-provisional application claims priority to and the benefit of, under 35 U.S.C. § 119(a). Taiwan Patent Application No. 109140880, filed in Taiwan on Nov. 20, 2020. The entire content of the above identified application is incorporated herein by reference.

FIELD

The present disclosure relates to a packaging structure, and more particularly to a packaging structure having a particular shape that can be formed after a series of folding to an integrally formed planar sheet and dispensing the use of a complicated and multi-piece cushioning structure.

BACKGROUND

Generally, a polygonal product is packaged in a relatively complicated paper structure, a foamed material, a molded paper support, or other cushioning materials, and the design of the package, including the choice of the packaging material and the design of the cushioning structure, depends on the shape, weight, structure, and test specifications of the product, the objective being to ensure close contact between the cushioning material and the product and to eliminate excessive gaps between the cushioning material and the product, so as to secure the product in place and provide sufficient protection for the product during transportation. If there are too many gaps between the cushioning material and the product, the product may shake violently, and hence collide frequently with the cushioning material, during transportation and end up damaged in appearance or function.

Continued from the above, when a relatively complicated paper cushioning structure is used to package a polygonal product, the costs of labor and material are higher, and there could be issues with excessive packaging and waste. When a foamed material is used for packaging, the cost of material is still high despite the protection provided by such a material, and the ideal of protecting the environment by using less plastic is betrayed. Using a molded paper support for packaging not only incurs high expenses for the molds, but also requires a long development time.

It is therefore an important issue in the packaging material industry to improve the design, and thereby overcome the aforesaid technical inadequacies, of the conventional packaging materials for polygonal products, so as to lower packaging cost, to enable a packaging material with a small cushioning space to provide sufficient protection, to allow a consumer to remove the packaging material of a product with ease, and to render the removed packaging material recyclable and reusable.

SUMMARY

In response to the aforesaid technical issues, as the result of extensive research and experiment, the present disclosure provides a packaging structure having resilient positioning flaps, which affords an effective solution to issues such as excessive packaging, high expenses, environmental unfriendliness, and long development time that result from the complexity and multi-piece design of the cushioning structure of the conventional packaging materials for polygonal products.

One aspect of the present disclosure is directed to a package structure that includes a foldable integrally formed sheet. The integrally formed sheet includes a main body portion, a first connecting portion, a second connecting portion, a first folding portion, a second folding portion, two first inserting flaps, two second inserting flaps, a left fixing portion, and a right fixing portion. The first connecting portion has a first edge connected to a left edge of the main body portion, and can be bent along a direction toward the main body portion. The second connecting portion has a first edge connected to a right edge of the main body portion, and can be bent along a direction toward the main body portion. The first folding portion extends outward from a front edge of the main body portion, and can be bent along a direction toward the main body portion. The second folding portion extends outward from a rear edge of the main body portion, and can be bent along a direction toward the main body portion. The two first inserting flaps extend outward from the first folding portion and are spaced apart from each other. The two second inserting flaps extend outward from the second folding portion and are spaced apart from each other. The left fixing portion is connected to a second edge of the first connecting portion, and is formed thereon with two first pressed lines and a left opening. The two first pressed lines are spaced apart from each other. The left fixing portion can be bent, along the two first pressed lines, along a direction toward the main body portion. A portion of a periphery of the left opening is formed with a plurality of left cuttings extending along at least one direction away from the left opening to form a plurality of left resilient positioning flaps. The left resilient positioning flaps can be bent away from the left opening. The right fixing portion is connected to a second edge of the second connecting portion, and is formed thereon with two second pressed lines and a right opening. The two second pressed lines are spaced apart from each other. The right fixing portion can be bent, along the two second pressed lines, along a direction toward the main body portion. A portion of a periphery of the right opening is formed with a plurality of right cuttings extending along at least one direction away from the right opening to form a plurality of right resilient positioning flaps. The right resilient positioning flaps can be bent away from the right opening. The foldable integrally formed sheet can be folded to position the left fixing portion on a left part of a top side of the main body portion, position the right fixing portion on a right part of the top side of the main body portion, position an area of the folded left fixing portion that is between the first pressed lines to be adjacent to or abut against an area of the folded right fixing portion that is between the second pressed lines, communicate the left opening with the right opening, form a receiving space defined by the main body portion, left fixing portion and right fixing portion, position the right resilient positioning flaps and the left resilient positioning flaps on a top side of the receiving space, and form a positioning opening communicated with the receiving space by free ends of the right resilient positioning flaps and the left resilient positioning flaps.

In certain embodiments, the right resilient positioning flaps and the left resilient positioning flaps can be pushed and bent toward a bottom side of the packaging structure by a base of a product when the product enters or is extended into the receiving space from the positioning opening, and can move upward to be engaged in a concave space of the product to position the product in the packaging structure once the base is moved past the free ends of the left resilient positioning flaps and of the right resilient positioning flaps.

Accordingly, the packaging structure can be a planar sheet before being rendered into its particular shape and therefore does not occupy much space during storage and transportation in its planar form. Once the packaging structure is folded into shape, the engaging effect of its resilient positioning flaps allows a product to be securely positioned in the packaging structure without using an additional fastening material. Accordingly, the overall packaging cost can be effectively lowered.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

Figure 1:
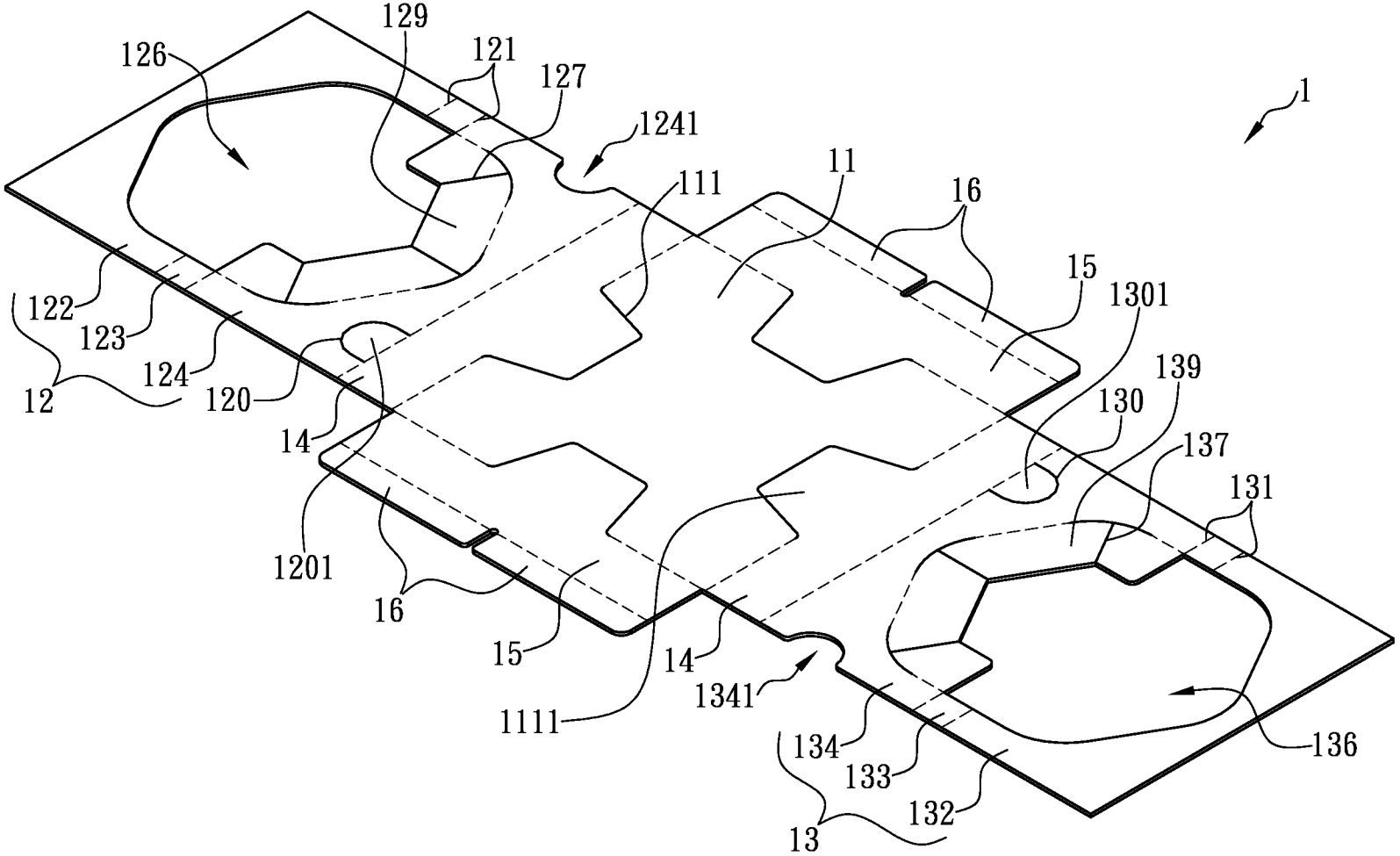
FIG. 1 is a schematic view of a packaging structure not being folded according to certain embodiments of the present disclosure.
Figure 2:
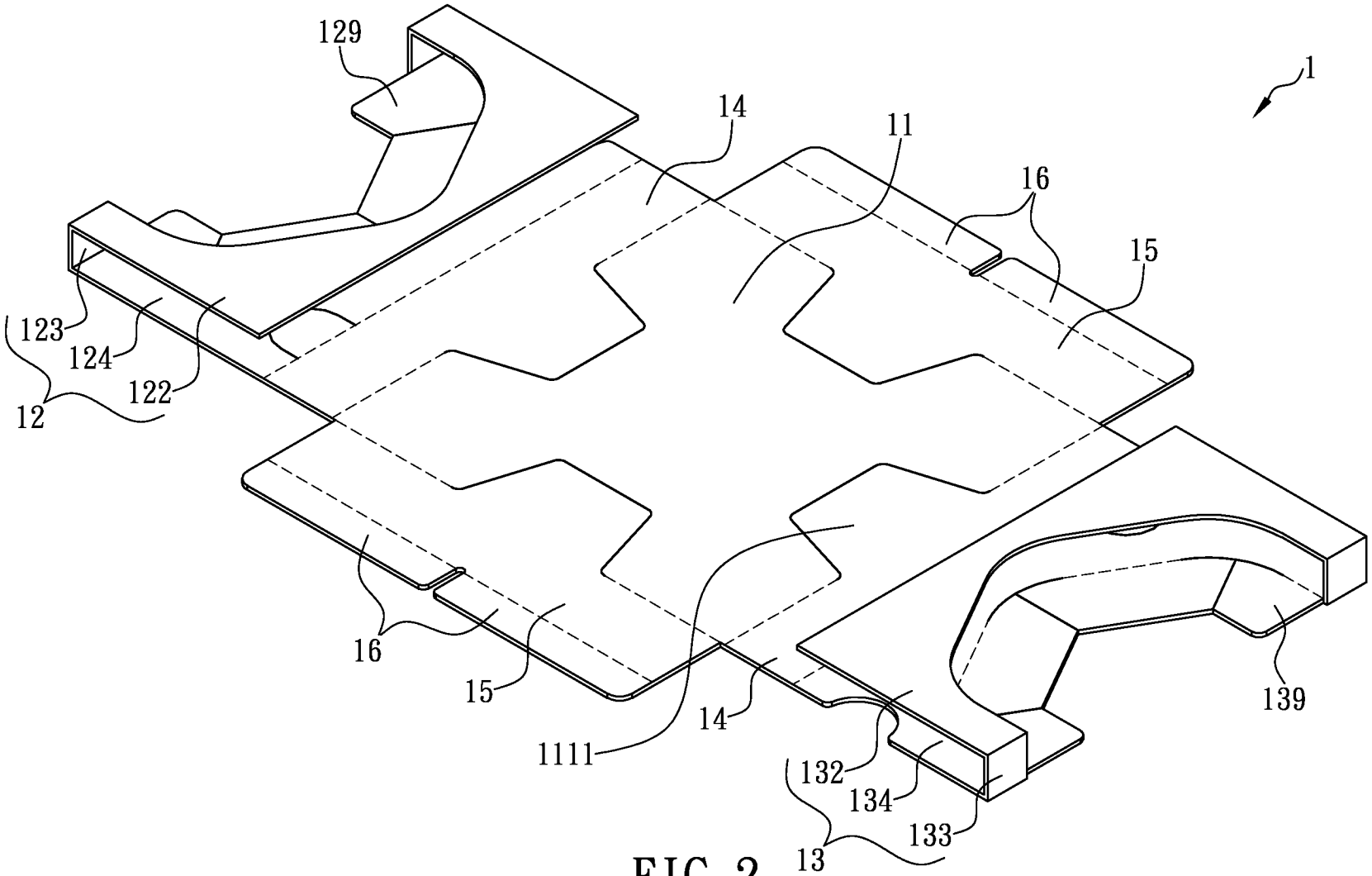
FIG. 2 is a schematic view of a left fixing portion and a right fixing portion being bent along pressed lines according to certain embodiments of the present disclosure.
Figure 3:
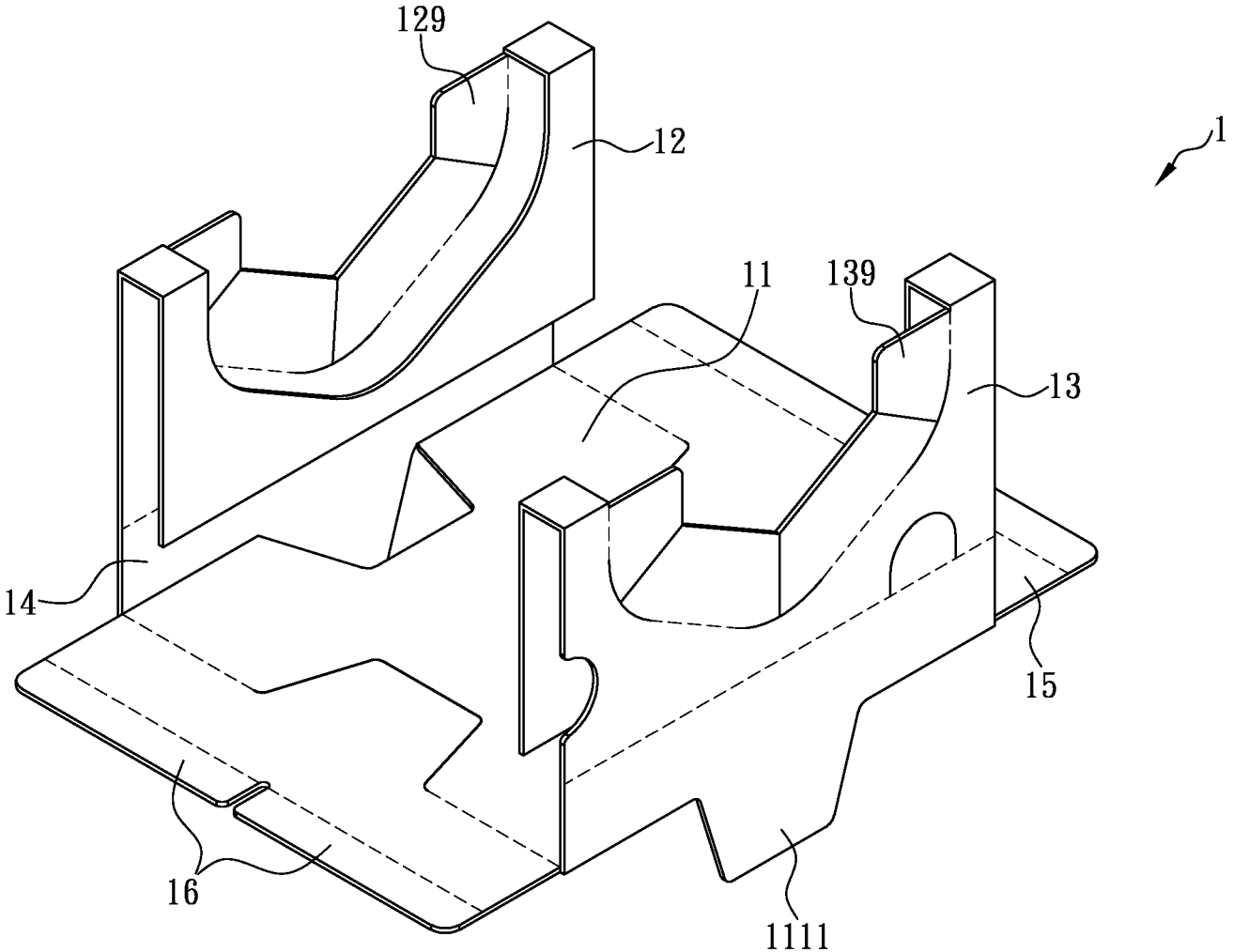
FIG. 3 is a schematic view of connecting portions being bent along a direction toward a main body portion according to certain embodiments of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, materials, objects, or the like, which are for distinguishing one component/material/object from another one only, and are not intended to, nor should be construed to impose any substantive limitations on the components, materials, objects, or the like.

The present disclosure provides a packaging structure 1 having resilient positioning flaps 129, 139 as shown in FIG. 1. To facilitate description, the front side of the packaging structure 1 or any element thereof is defined as the side facing the lower left corner of FIG. 1, the rear side as the side facing the upper right corner of FIG. 1, the left side as the side facing the upper left corner of FIG. 1, the right side as the side facing the lower right corner of FIG. 1, the top side as the side facing the top edge of FIG. 1, and the bottom side as the side facing the bottom edge of FIG. 1. In certain embodiments, the packaging structure 1 is an integrally formed sheet and can be folded into a particular shape. The sheet may be made of paper, plastic, or any other bendable/foldable material, as long as the sheet has the structures, and can produce the effects, described infra. The sheet includes a main body portion 11, a left fixing portion 12, and a right fixing portion 13. The left edge of the main body portion 11 is connected to a first edge of a first connecting portion 14, and the right edge of the main body portion 11 is connected to a first edge of a second connecting portion 14. A second edge of the first connecting portion 14 is connected to the left fixing portion 12. A second edge of the second connecting portion 14 is connected to the right fixing portion 13. The first and second connecting portions 14 can be bent along a direction toward the main body portion 11. One folding portion 15 is extended from and connected to the front edge of the main body portion 11, and another folding portion 15 is extended from and connected to the rear edge of the main body portion 11. Each of the two folding portions 15 can also be bent along a direction toward the main body portion 11. Two inserting flaps 16 are extended outward from and connected to each of the folding portions 15, and are spaced apart from each other.

Referring to FIG. 1 to FIG. 4, in certain embodiments, the left fixing portion 12 is provided thereon with two pressed lines 121, and the two pressed lines 121 are spaced apart from each other such that the left fixing portion 12 is divided by the two pressed lines 121 into a first left-side fixing region 122, a second left-side fixing region 123, and a third left-side fixing region 124. The two pressed lines 121 are located on two opposite sides of the second left-side fixing region 123, respectively. The first left-side fixing region 122 is located to the left of the second left-side fixing region 123, and the third left-side fixing region 124 is located to the right of the second left-side fixing region 123. The sheet can be folded along the two pressed lines 121 along a direction toward the main body portion 11 to an extent that the inner surface of the first left-side fixing region 122 faces the inner surface of the third left-side fixing region 124 (see FIG. 2). The first connecting portion 14 can be bent along a direction toward the main body portion 11 (see FIG. 3). The third left-side fixing region 124 can be bent along its joint with the first connecting portion 14 to the extent that the outer surface of the first left-side fixing region 122 faces the inner surface of the main body portion 11 (see FIG. 4), the folded third left-side fixing region 124 is formed and positioned above the main body portion 11, the outer surface of the third left-side fixing region 124 forms an exposed part of the packaging structure 1, the front ends of the folded first left-side fixing region 122, second left-side fixing region 123, third left-side fixing region 124 and the first connecting portion 14 form a first left assembly opening 125, and the rear ends of the folded first left-side fixing region 122, second left-side fixing region 123, third left-side fixing region 124 and the first connecting portion 14 form a second left assembly opening 125 (see FIG. 4).

Referring to FIG. 1 to FIG. 5, in certain embodiments, the right fixing portion 13 is provided thereon with two pressed lines 131, and the two pressed lines 131 are spaced apart from each other such that the right fixing portion 13 is divided by the two pressed lines 131 into a first right-side fixing region 132, a second right-side fixing region 133, and a third right-side fixing region 134. The two pressed lines 131 are located on two opposite sides of the second right-side fixing region 133, respectively. The first right-side fixing region 132 is located to the right of the second right-side fixing region 133, and the third right-side fixing region 134 is located to the left of the second right-side fixing region 133. The sheet can be folded along the two pressed lines 131 along a direction toward the main body portion 11 to an extent that the inner surface of the first right-side fixing region 132 faces the inner surface of the third right-side fixing region 134 (see FIG. 2). The second connecting portion 14 can be bent along a direction toward the main body portion 11 (see FIG. 3). The third right-side fixing region 134 can be bent along its joint with the second connecting portion 14 to the extent that the outer surface of the first right-side fixing region 132 faces the inner surface of the main body portion 11 (see FIG. 4), the folded third right-side fixing region 134 is formed and positioned above the main body portion 11, the outer surface of the third right-side fixing region 134 forms an exposed part of the packaging structure 1, the front ends of the folded first right-side fixing region 132, second right-side fixing region 133, third right-side fixing region 134 and the second connecting portion 14 form a first right assembly opening 135, and the rear ends of the folded first right-side fixing region 132, second right-side fixing region 133, third right-side fixing region 134 and the second connecting portion 14 form a second right assembly opening 135 (see FIG. 4).

Figure 4:
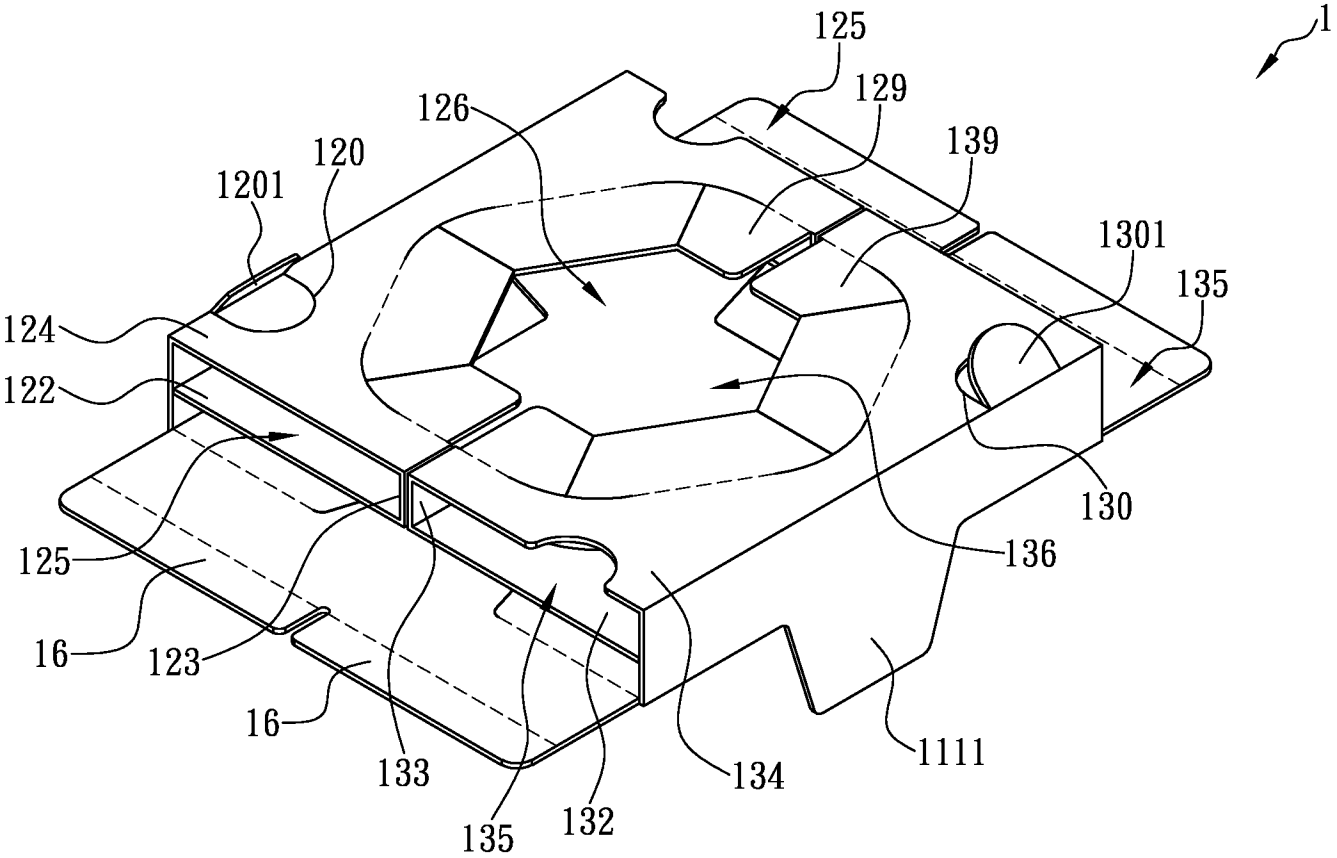
FIG. 4 is a schematic view of the left fixing portion and the right fixing portion being bent along a direction toward the main body portion according to certain embodiments of the present disclosure.
Figure 5:
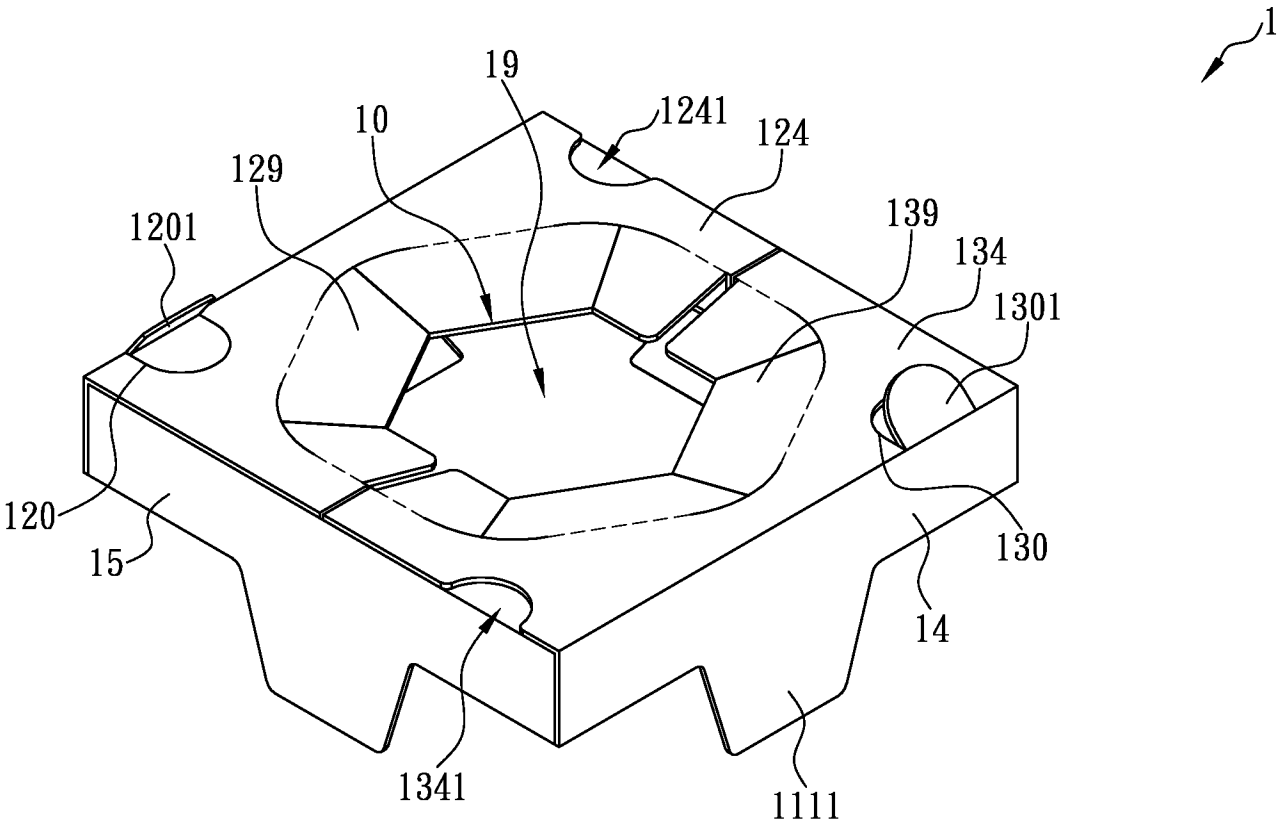
FIG. 5 is a schematic view of the packaging structure being in a fixedly folded state according to certain embodiments of the present disclosure.

Referring to FIG. 4 and FIG. 5, in certain embodiments, the sheet can be folded into the shape shown in FIG. 4. The left fixing portion 12 can be folded and positioned on the left part of the top side of the main body portion 11, and the right fixing portion 13 can be folded and positioned on the right part of the top side of the main body portion 11, such that the left and right assembly openings 125 and 135 at the same side are spaced apart from each other by a distance, for example, by at least the sheet thickness of the second left-side fixing region 123 and the sheet thickness of the second right-side fixing region 133. Moreover, the area between the two pressed lines 121 of the folded left fixing portion 12 (i.e., the second left-side fixing region 123) is adjacent to or abuts against the area between the two pressed lines 131 of the folded right fixing portion 13 (i.e., the second right-side fixing region 133), so if the left fixing portion 12 and the right fixing portion 13 start to unfold outward (i.e., move away from the main body portion 11) due to their own restoring forces, the second left-side fixing region 123 and the second right-side fixing region 133 will be blocked by each other and keep the left fixing portion 12 and the right fixing portion 13 where they are, preventing the two fixing portions 12 and 13 from parting, and thereby providing higher stability to the packaging structure 1. The inserting flaps 16 can be respectively inserted into the left assembly openings 125 and the right assembly openings 135, so as to cover the corresponding left assembly openings 125 and the right assembly openings 135.

Figure 6:
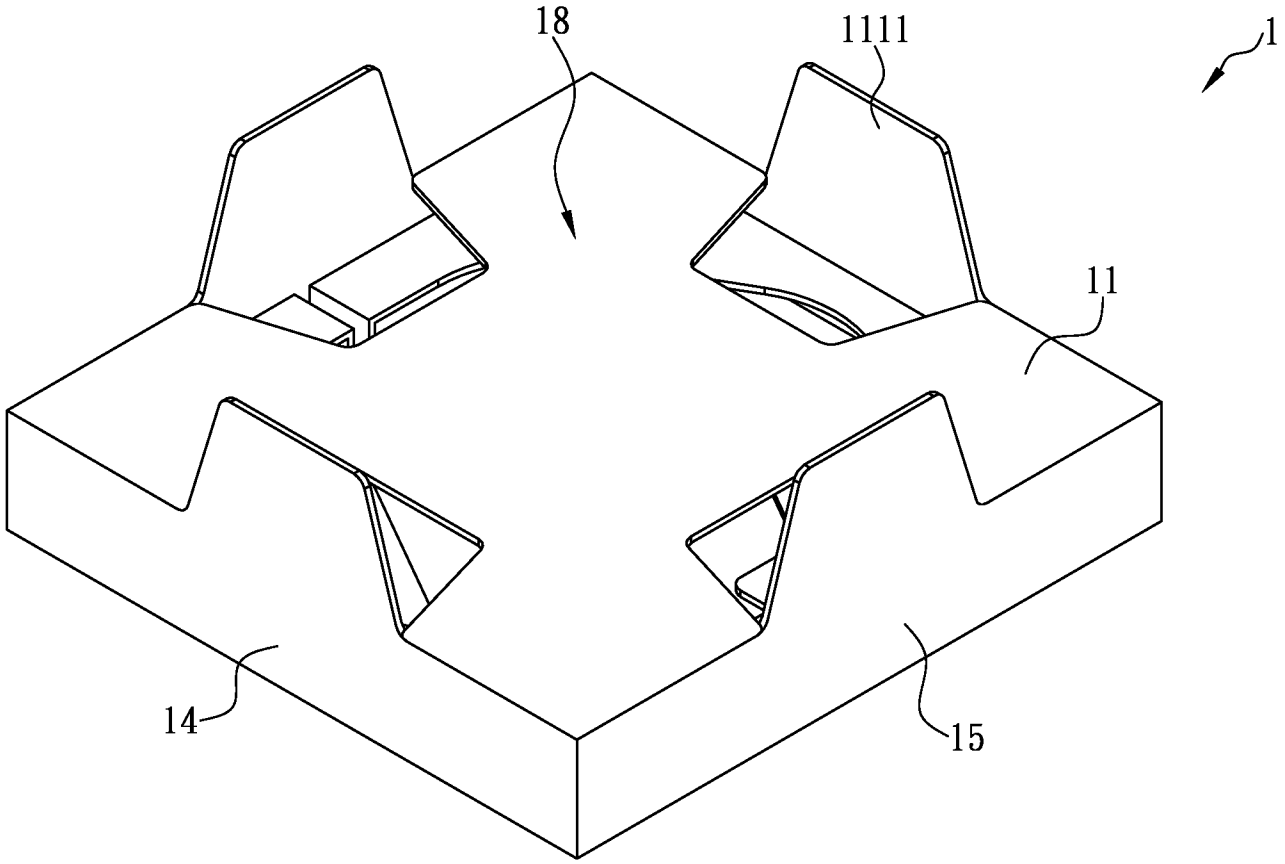
FIG. 6 is a perspective top view of a bottom space formed by the packaging structure according to certain embodiments of the present disclosure.
Figure 7:
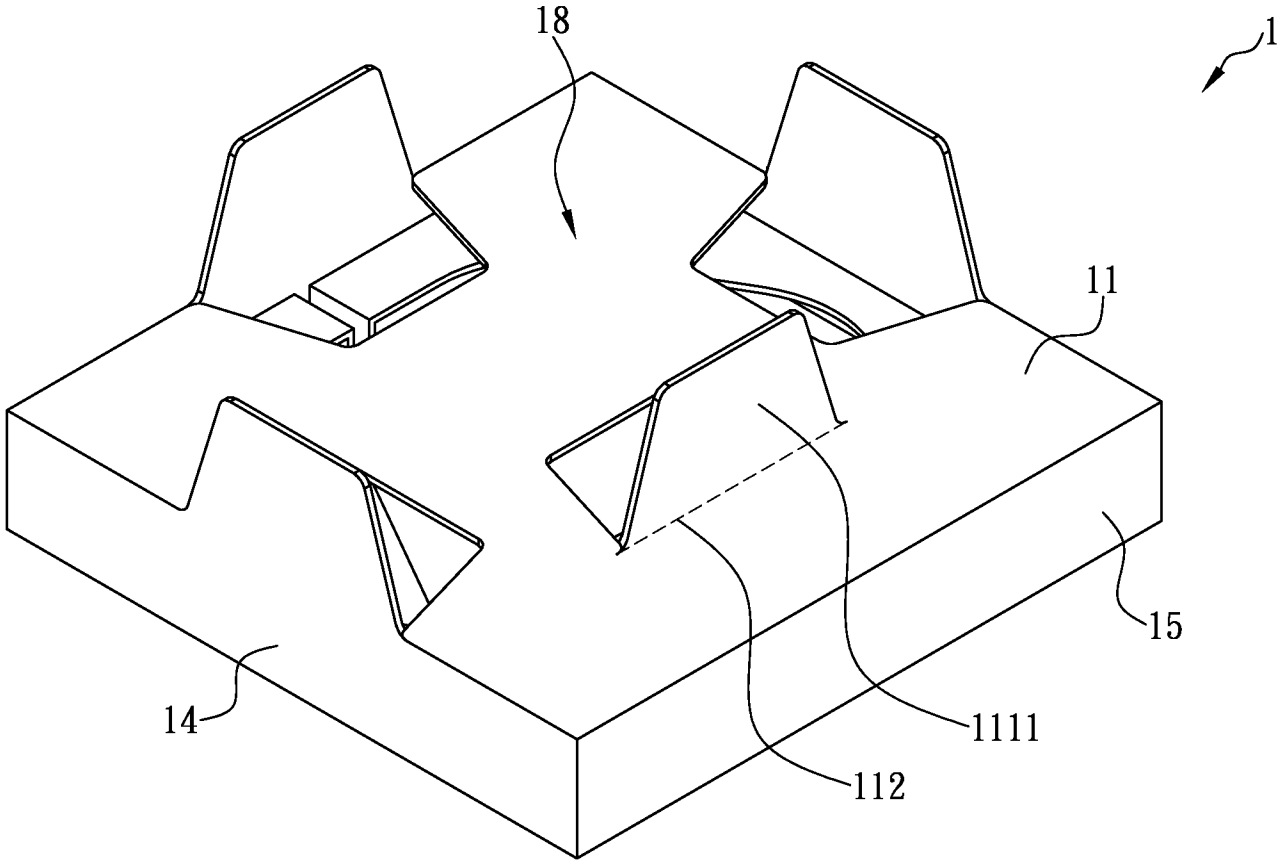
FIG. 7 is a perspective top view of a bottom space formed by the packaging structure according to certain embodiments of the present disclosure.

Referring to FIG. 1, FIG. 6, and FIG. 7, in certain embodiments, the main body portion 11 is provided with a plurality of U-shaped cutting lines 111 to form a plurality of supporting members 1111. Each U-shaped cutting line 111 has two ends, and each end is arranged at the joint between the main body portion 11 and a connecting portion 14 corresponding and connected to the U-shaped cutting line 111 or the joint between the main body portion 11 and a folding portion 15 corresponding and connected to the U-shaped cutting line 111, that is, arranged at at least one of the four edges of the main body portion 11. In a folded state of the packaging structure 1, the free end of each supporting member 1111 is folded to point away from the bottom side of the packaging structure 1. When the folded packaging structure 1 is placed into a packaging box (not shown), the bottom edge of each of the supporting members 111 can abut against the inner wall of the packaging box to form at least one bottom space 18 (see FIG. 6) between the main body portion 11 and the inner wall of the packaging box as a storage space for the accessories (e.g., the transformer) of the packaged product 2. However, the present disclosure is not limited thereto. In certain embodiments, the locations and number of the U-shaped cutting lines 111 can be adjusted according to product requirements. For example, the U-shaped cutting lines 111 may be so arranged that their ends are located only at the joints between the main body portion 11 and the two connecting portions 14 or only at the joints between the main body portion 11 and the two folding portions 15. In certain embodiments, at least one U-shaped cutting line 111 is provided at or adjacent to a central area of the main body portion 11 (see FIG. 7), and a pressed line 112 is provided between the two ends of this U-shaped cutting line 111 so that the supporting member 111 defined by the U-shaped cutting line 111 can be bent along the pressed line 112 away from the bottom side of the folded packaging structure 1 to an intended position.

Referring to FIG. 1 and FIG. 5, in certain embodiments, the left fixing portion 12 can be provided with a left opening 126 that extends from the first left-side fixing region 122 across the second left-side fixing region 123 to the third left-side fixing region 124. A portion of the periphery of the third left-side fixing region 124 that defines, collectively with the first left-side fixing region 122 and the second left-side fixing region 123, the left opening 126 is provided with a plurality of left cuttings 127 that extend along at least one direction away from the left opening 126 to form a plurality of left resilient positioning flaps 129. The left resilient positioning flaps 129 can be bent away from the left opening 126. The right fixing portion 13 can be provided with a right opening 136 that extends from the first right-side fixing region 132 across the second right-side fixing region 133 to the third right-side fixing region 134. A portion of the periphery of the third right-side fixing region 134 that defines, collectively with the first right-side fixing region 132 and the second right-side fixing region 133, the right opening 136 is provided with a plurality of right cuttings 137 that extend along at least one direction away from the right opening 136 to form a plurality of right resilient positioning flaps 139. The right resilient positioning flaps 139 can be bent away from the right opening 136. In a folded state of the packaging structure 1, a portion of the left opening 126 is in communication with a portion of the right opening 136.

Referring to FIG. 5 and FIG. 8 to FIG. 10, in certain embodiments, a receiving space 19 can be formed and defined by the main body portion 11, left fixing portion 12 and right fixing portion 13 of the packaging structure 1 in a folded state. The left resilient positioning flaps 129 and the right resilient positioning flaps 139 extend to, that is, are positioned at, the top side of the receiving space 19, with a positioning opening 10 formed and surrounded by the edges of the free ends of the left and right resilient positioning flaps 129 and 139. The positioning opening 10 may be polygonal. However, the present disclosure is not limited thereto. The positioning opening 10 is in communication with the receiving space 19.

Figure 8:
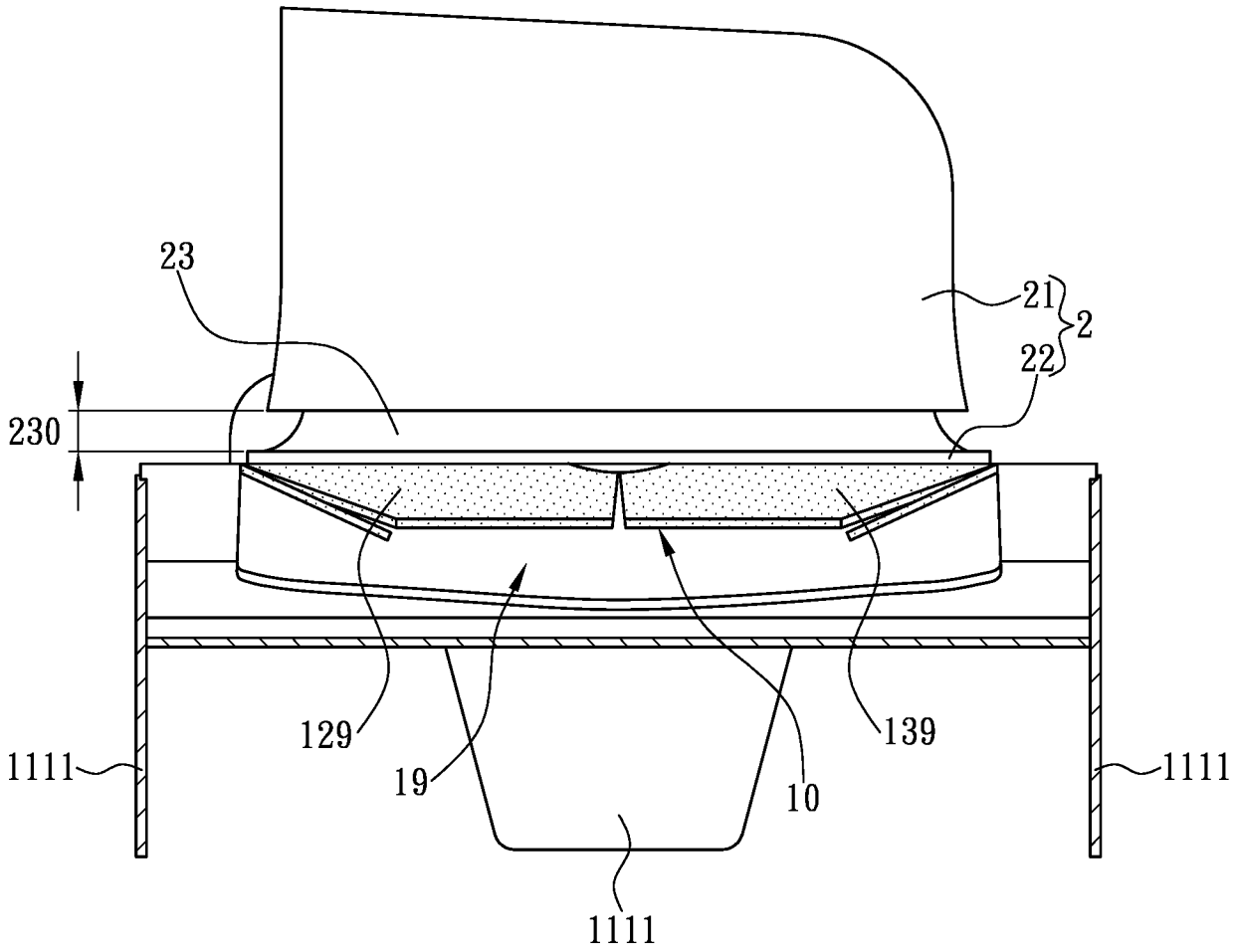
FIG. 8 is a schematic view of a product entering/extending into a receiving space through a positioning opening according to certain embodiments of the present disclosure.
Figure 9:
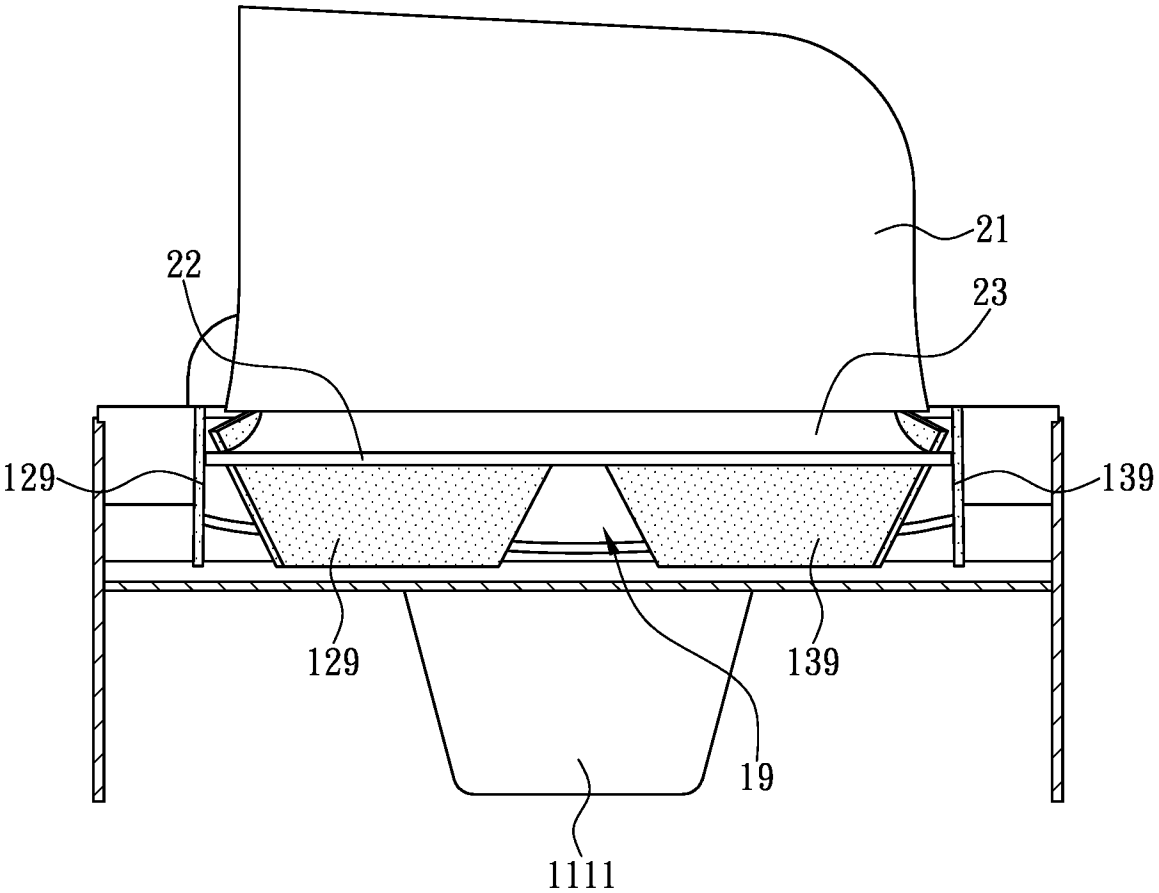
FIG. 9 is a schematic view of resilient positioning flaps being bent and deformed toward the bottom side of the packaging structure according to certain embodiments of the present disclosure.
Figure 10:
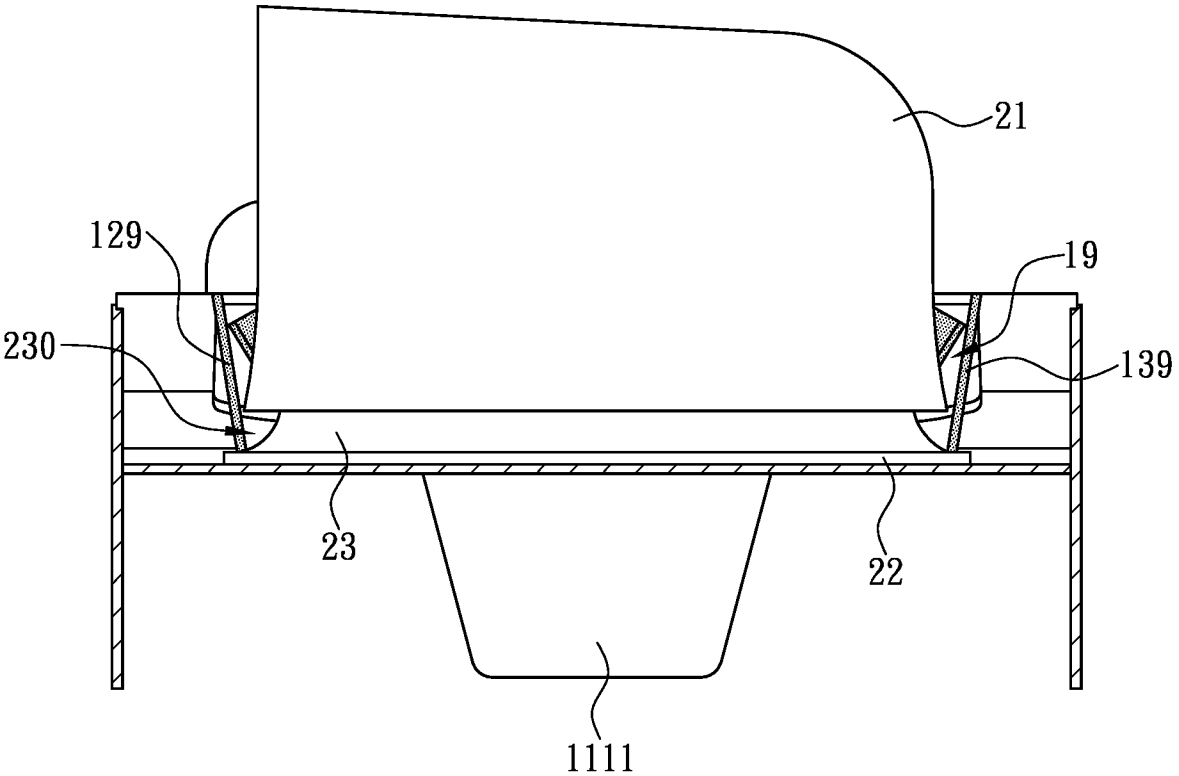
FIG. 10 is a schematic view of the resilient positioning flaps extending into a concave space between a base and a main body of the product.

Referring to FIG. 8 to FIG. 10, in certain embodiments, the left resilient positioning flaps 129 and the right resilient positioning flaps 139 can be engaged in a concave space 230 of a product 2 that is defined by a neck 23 of the product 2 when the product 2 extends into the receiving space 19 through the positioning opening 10. The neck 23 of the product 2 can be formed between a main body 21 and a base 22 of the product 2 due to the outer diameter difference between the main body 21 and the base 22, and the concave space 230 is defined by the peripheral of the neck 23. For example, as shown in FIG. 8 to FIG. 10, the neck 23 and the concave space 230 can be formed at a portion of the base 22 that is adjacent to the top side of the base 22 when the width of the top side of the base 22 is smaller than the width of the bottom side of the main body 21 and the width of the bottom side of the base 22 is larger than the width of the top side of the base 22, that is, a space sunken toward the central axis of the product 2 is formed in the portion of the base 22 that is adjacent to the top side of the base 22. However, the present disclosure is not limited thereto. In certain embodiments, the neck 23 is not necessarily formed at the base 22, and may be formed at the main body 21. In certain embodiments, the product 2 may have an integrally formed housing and does not have the main body 21 and the base 22 as two separate elements. As long as a product has a neck forming a concave space in which the left resilient positioning flaps 129 and the right resilient positioning flaps 139 can be engaged, such a product falls within the scope of the product 2 defined by the present disclosure, and a portion of such a product that lies below the left resilient positioning flaps 129 and the right resilient positioning flaps 139 when the product is positioned in the packaging structure 1 falls within the scope of the base 22 as defined by the present disclosure.

Referring again to FIG. 5 and FIG. 8 to FIG. 10, in certain embodiments, when the product 2 extends into the receiving space 19 through the positioning opening 10, and the width of the base 22 of the product 2 is larger than the width of the positioning opening 10, the base 22 pushes, bends and deforms the left resilient positioning flaps 129 and the right resilient positioning flaps 139 toward the bottom side of the packaging structure 1 (see FIG. 9). Once the base 22 is moved past the free ends of the left resilient positioning flaps 129 and of the right resilient positioning flaps 139, the left resilient positioning flaps 129 and the right resilient positioning flaps 139 move upward by their own restoring forces, which tend to restore the positioning flaps to their respective pre-deformed positions. As a result, the free ends of the left resilient positioning flaps 129 and of the right resilient positioning flaps 139 are engaged in the concave space 230 between the base 22 and the main body 21 of the product 2 (see FIG. 10) to position the product 2 in the packaging structure 1. The product 2 will be directly blocked by the packaging structure 1 when subjected to a force that acts downward or in a horizontal direction (e.g., forward, rearward, leftward, or rightward), and when the product 2 is subjected to an upward force, the base 22 will be blocked by the left resilient positioning flaps 129 and the right resilient positioning flaps 139 such that the product 2 is kept from separating from the packaging structure 1. Therefore, the packaging structure 1 can protect the product 2 with little cushioning space, and can effectively prevent the product 2 from falling (i.e., from separating from the packaging structure 1) and provide shock absorption while the product 2 is being transported.

Referring to FIG. 1 and FIG. 5, in certain embodiments, the third left-side fixing region 124 is provided with a cutting 120, and the third right-side fixing region 134 is provided with a cutting 130, so as to facilitate removal of the packaging structure 1 from inside a packaging box. The cuttings 120 and 130 can be semicircular and be respectively provided at the joint between the left fixing portion 12 and the first connecting portion 14 and the joint between the right fixing portion 13 and the second connecting portion 14 to form pulling portions 1201 and 1301 respectively. Each pulling portion 1201 or 1301 can be bent away from the receiving space 19 to its intended position so that a user can take the packaging structure 1 out of a packaging box by applying a pulling force to the two pulling portions 1201 and 1301. However, the present application is not limited thereto. In certain embodiments, the shape of the cuttings 120 and 130 can be adjusted according to product requirements (e.g., into a rectangular shape), as long as the pulling portions 1201 and 1301 can be formed by bending the packaging structure 1, and a user can easily remove the packaging structure 1 from inside a packaging box with the aid of the pulling portions 1201 and 1301.

Referring again to FIG. 1 and FIG. 5, in certain embodiments, the third left-side fixing region 124 is provided with at least one aperture 1241, and the third right-side fixing region 134 is provided with at least one aperture 1341, so as to facilitate a user to unfold a folded packaging structure 1. The at least one aperture 1241 can be formed at at least one end of the third left-side fixing region 124, and the at least one aperture 1341 can be formed at at least one end of the third right-side fixing region 134 that is opposite to the at least one end of the third left-side fixing regions 124 at which the at least one aperture 1241 is formed. For example, the aperture 1241 and the aperture 1341 can be formed at two opposite ends of the packaging structure 1, such as the aperture 1241 being formed at the front end of the third left-side fixing region 124 and the aperture 1341 being formed at the rear end of the third right-side fixing region 134, or the aperture 1241 being formed at the rear end of the third left-side fixing region 124 and the aperture 1341 being formed at the front end of the third right-side fixing region 134. The apertures 1241 and 1341 can partially expose the inserting flaps 16 corresponding to the apertures 1241 and 1341 when the packaging structure 1 is folded, so that a user can easily move those inserting flaps 16 out of the corresponding left assembly opening(s) 125 and the corresponding right assembly opening(s) 135 respectively by the two apertures 1241 and 1341, so as to release the packaging structure 1 from a fixedly folded state.

Accordingly, referring again to FIG. 1 to FIG. 5, the present disclosure provides an integrally formed sheet whose left fixing portion 12 and right fixing portion 13 can be folded along a direction toward the main body portion 11 to be adjacent to or abut against each other, and whose inserting flaps 16 can be subsequently inserted into the left assembly openings 125 and the right assembly openings 135 respectively to present a folding of the packaging structure 1. As the packaging structure 1 can be rendered into its particular shape simply by folding the sheet, without using any adhesive or binding material, a worker or user can fold the packaging structure 1 into shape with ease, and the overall packaging cost is effectively lowered. In addition, the packaging structure 1 can be easily unfolded and removed from the packaged product to facilitate recycling and reuse of the packaging structure 1.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A package structure including a foldable integrally formed sheet, the integrally formed sheet includes:

a main body portion;

a first connecting portion having a first edge connected to a left edge of the main body portion and configured to be bent along a direction toward the main body portion;

a second connecting portion having a first edge connected to a right edge of the main body portion and configured to be bent along a direction toward the main body portion;

a first folding portion extending outward from a front edge of the main body portion and configured to be bent along a direction toward the main body portion;

a second folding portion extending outward from a rear edge of the main body portion and configured to be bent along a direction toward the main body portion;

two first inserting flaps extending outward from the first folding portion and spaced apart from each other;

two second inserting flaps extending outward from the second folding portion and spaced apart from each other;

a left fixing portion connected to a second edge of the first connecting portion, formed thereon with two first pressed lines that are spaced apart from each other and a left opening, and configured to be bent, along the two first pressed lines, along a direction toward the main body portion, wherein a portion of a periphery of the left opening is formed with a plurality of left cuttings extending along at least one direction away from the left opening to form a plurality of left resilient positioning flaps configured to be bent away from the left opening; and a right fixing portion connected to a second edge of the second connecting portion, formed thereon with two second pressed lines that are spaced apart from each other and a right opening, and configured to be bent, along the two second pressed lines, along a direction toward the main body portion, wherein a portion of a periphery of the right opening is formed with a plurality of right cuttings extending along at least one direction away from the right opening to form a plurality of right resilient positioning flaps configured to be bent away from the right opening, wherein the foldable integrally formed sheet is configured to be folded to position the left fixing portion on a left part of a topside of the main body portion, position the right fixing portion on a right part of the top side of the main body portion, position a first area of the folded left fixing portion that is between the first pressed lines to be adjacent to or abut against a second area of the folded right fixing portion that is between the second pressed lines, communicate the left opening with the right opening, form a receiving space defined by the main body portion, left fixing portion and right fixing portion, position the right resilient positioning flaps and the left resilient positioning flaps on a top side of the receiving space, and form a positioning opening communicated with the receiving space by edges of free ends of the right resilient positioning flaps and the left resilient positioning flaps.

2. The packaging structure according to claim 1, wherein the right resilient positioning flaps and the left resilient positioning flaps are configured to, when a product enters or is extended into the receiving space from the positioning opening, be pushed and bent toward a bottom side of the packaging structure by a base of the product, and once the base is moved past the free ends of the left resilient positioning flaps and of the right resilient positioning flaps, move upward to be engaged in a concave space of the product to position the product in the packaging structure.

3. The packaging structure according to claim 1, wherein the positioning opening is polygonal.

4. The packaging structure according to claim 1, wherein the left fixing portion is configured to, when folded to be positioned on the top side of the main body portion, form left assembly openings with a front end and a rear end of the first connecting portion, and the right fixing portion is configured to, when folded to be positioned on the top side of the main body portion, form right assembly openings with a front end and a rear end of the second connecting portion.

5. The packaging structure according to claim 1, wherein the main body portion is provided with a plurality of U-shaped cutting lines to form a plurality of supporting members, each of the supporting members having a free end configured to be folded to point away from a bottom side of the packaging structure.

6. The packaging structure according to claim 5, wherein two ends of each of the U-shaped cutting lines are located at a joint between the main body portion and one of the first and second connecting portions or a joint between the main body portion and one of the first and second folding portions.

7. The packaging structure according to claim 6, wherein a bottom edge of each of the supporting members is configured to, when the packaging structure is folded and placed into a packaging box, abut against an inner wall of the packaging box to form at least one bottom space between the main body portion and the inner wall of the packaging box.

8. The packaging structure according to claim 5, wherein at least one of the U-shaped cutting lines is provided at or adjacent to a central area of the main body portion, a pressed line is provided between the two ends of the U-shaped cutting line, and a supporting member defined by the U-shaped cutting line is configured to be bent, along the pressed line, away from the bottom side of the packaging structure.

9. The packaging structure according to claim 8, wherein a bottom edge of each of the supporting members is configured to, when the packaging structure is folded and placed into a packaging box, abut against an inner wall of the packaging box to form at least one bottom space between the main body portion and the inner wall of the packaging box.

10. The packaging structure according to claim 5, wherein a bottom edge of each of the supporting members is configured to, when the packaging structure is folded and placed into a packaging box, abut against an inner wall of the packaging box to form at least one bottom space between the main body portion and the inner wall of the packaging box.

11. The packaging structure according to claim 1, wherein each of the left fixing portion and the right fixing portion is provided with a cutting to form a pulling portion configured to be bent away from the receiving space.

12. The packaging structure according to claim 1, wherein at least one first aperture is formed at at least one of a front end and a rear end of the left fixing portion, at least one second aperture is formed at at least one of a front end and a rear end of the right fixing portion, and the first and second apertures are located at two opposite ends of the packaging structure, respectively, and configured to partially expose at least two of the first and second inserting flaps corresponding to the apertures when the foldable integrally formed sheet is folded to position the left fixing portion and the right fixing portion on the top side of the main body portion and the two inserting flaps are inserted into assembly openings corresponding to the two inserting flaps that are respectively formed by one of the left and right fixing portions and one of the first and second connecting portions.

* * * * *